US006964440B2

(12) United States Patent
Lebsack et al.

(10) Patent No.: US 6,964,440 B2
(45) Date of Patent: Nov. 15, 2005

(54) OUTSIDE VEHICLE DOOR HANDLE

(75) Inventors: Patrick James Lebsack, Bay City, MI (US); Jeffrey Carroll, West Bloomfield, MI (US); DeeAnna Stiglich, Highland, MI (US)

(73) Assignee: Intier Automotive Closures Inc., Newmarket (CA)

( * ) Notice: Subject to any disclaimer, the term of this patent is extended or adjusted under 35 U.S.C. 154(b) by 48 days.

(21) Appl. No.: 10/606,920

(22) Filed: Jun. 26, 2003

(65) Prior Publication Data

US 2004/0021326 A1 Feb. 5, 2004

Related U.S. Application Data

(60) Provisional application No. 60/392,441, filed on Jun. 28, 2002.

(51) Int. Cl.[7] ..... E05B 3/00

(52) U.S. Cl. ..... 292/336.3; 292/DIG. 23; 296/146

(58) Field of Search ..... 292/336.3, 347, 292/DIG. 53, DIG. 23; 296/146; 49/366; 16/412

(56) References Cited

U.S. PATENT DOCUMENTS 4,796,929 A 1/1989 Gergoe
4,930,836 A 6/1990 Grinn
5,749,611 A * 5/1998 Watson et al. ..... 292/336.3
5,803,516 A * 9/1998 Hempel ..... 292/336.3
5,927,775 A * 7/1999 Trammell, Jr. ..... 292/348
6,059,352 A 5/2000 Heldt et al.
6,264,254 B1 * 7/2001 Siegfried et al. ..... 292/336.3
6,550,845 B1 * 4/2003 Pietryga ..... 296/146.1
6,561,557 B2 * 5/2003 Choi ..... 292/336.3

* cited by examiner

*Primary Examiner*—Gary Estremsky
(74) *Attorney, Agent, or Firm*—Clark Hill PLC

(57) ABSTRACT

A handle assembly unlatches a door latch to open a door of a motor vehicle. The handle assembly includes a housing secured to the door. The housing defines a well. A handle is pivotally secured to the housing for movement between a rest position and actuating positions into and out of the well. The handle assembly also includes a bell crank that is pivotally mounted to the housing and operatively engaged with the handle. In addition, the handle assembly includes a release lever that is pivotally mounted to the housing and selectively coupled to the bell crank. The release lever is operatively connected to the door latch. Movement of the handle in either direction from its rest position pivots the bell crank and the release lever together relative to the housing to unlatch the door.

30 Claims, 9 Drawing Sheets

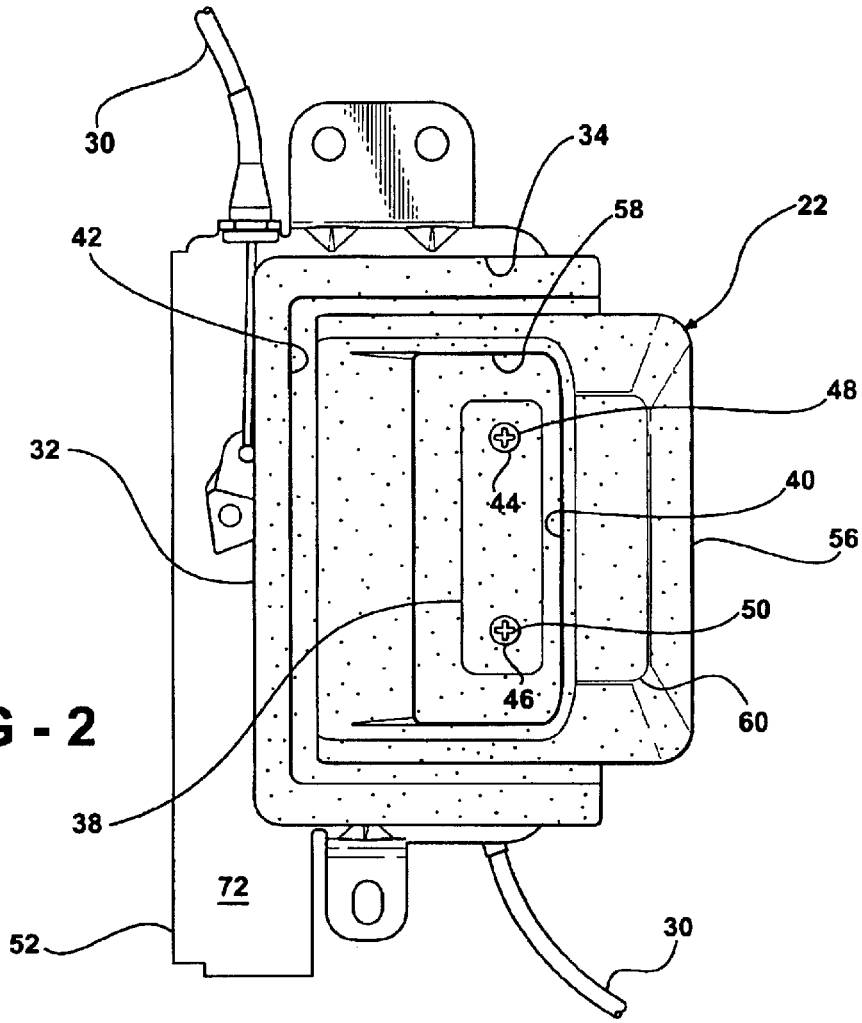
FIG - 2
FIG - 3
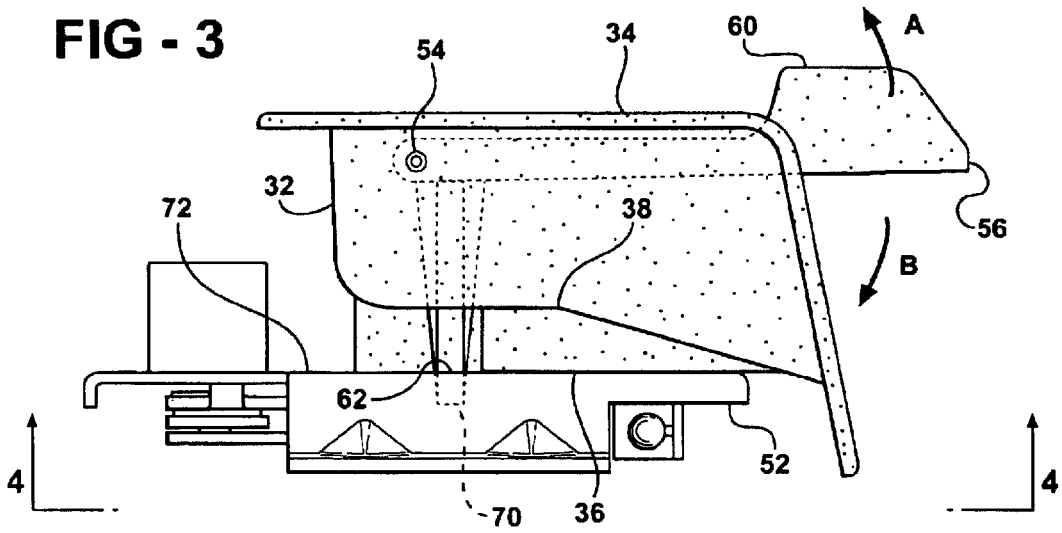

OUTSIDE VEHICLE DOOR HANDLE

CROSS-REFERENCE TO RELATED APPLICATION

This application claims the benefit of U.S. Provisional Patent Application Ser. No. 60/392,441, filed Jun. 28, 2002.

FIELD OF THE INVENTION

This invention relates to a handle assembly for opening a door of a motor vehicle. More particularly, the invention relates to a handle assembly including a bidirectionally movable door handle for opening a door from inside and outside of a motor vehicle.

DESCRIPTION OF RELATED ART

Many pick-up trucks include a passenger cab having a rear seat positioned behind a front row of seats for accommodating additional passengers. These pick-up trucks typically include a third or fourth rear door located directly behind a front door to aid passengers when entering and exiting the rear seats. The rear door also provides convenient access to the space behind the front row of seats during loading and unloading of items.

In certain pick-up trucks, the front and rear doors swing open in opposite directions from one another, historically referred to as a "clamshell design". These pick-up trucks generally include an inside handle mounted along an inner surface of the rear door for actuation from inside the motor vehicle. In addition, a second handle is provided along a forward vertical edge of the rear door for actuation from outside the motor vehicle.

One example of a rear door including multiple handles is provided in U.S. Pat. No. 5,794,611 to Watson et al., which discloses a door latch remote control assembly for a motor vehicle having a dual-door arrangement. The motor vehicle includes a shut face door opening handle and an inside handle mounted to a rear door. The handles are operatively connected to upper and lower door latches for opening the rear door. The door latch remote control assembly includes a back plate for supporting first and second operating levers, which are actuated by the handles. The first and second operating levers are pivotally mounted to a split pin. A bellcrank release lever is also mounted along the split-pin for movement between a resting position and a door latch releasing position. The bellcrank release lever, which includes a first arcuate guide slot, is connected by links to the door latches. A locking lever pivots on the back plate via a pivot pin disposed parallel to the split pin. The locking lever includes a second arcuate guide slot extending between a proximate end and a distal end. A link pin extends through the first and second arcuate guide slots. When the locking lever is in a release mode, the link pin contacts the proximate end of the second arcuate guide slot. As a result, the locking lever holds the link pin at a distal end of the first arcuate guide slot of the bellcrank release lever. The bellcrank release lever can then be pivoted about the split pin to a latch release position, in which the link pin contacts a distal end of the second arcuate guide slot. When the locking lever is in a locking mode, the second arcuate guide slot holds the link pin in contact with a proximate end of the first arcuate guide slot.

SUMMARY OF THE INVENTION

The use of multiple handles is not cost-effective due to the additional parts required. Thus, a single handle that may be actuated from both inside and outside the pick-up truck would be desirable for reducing the number of parts incorporated in a pick-up truck having a rear or third door.

Therefore, according to one aspect of the invention, there is provided a handle assembly for unlatching a door latch to open a door of a motor vehicle. The handle assembly includes a housing secured to the door. The housing defines a well. A handle is pivotally secured to the housing for movement between a rest position and actuating positions into and out of the well. The handle assembly also includes a bell crank that is pivotally mounted to the housing and operatively engaged with the handle. In addition, the handle assembly includes a release lever that is pivotally mounted to the housing and selectively coupled to the bell crank. The release lever is operatively connected to the door latch. Movement of the handle in either direction from its rest position pivots the bell crank and the release lever together relative to the housing to unlatch the door.

According to a second aspect of the invention, there is provided a handle assembly for unlatching a door latch to open a door of a motor vehicle. The handle assembly includes a housing secured to the door. The housing defines a well. A handle is pivotally secured to the housing for movement between a rest position and first and second actuating positions into and out of the well respectively. The handle assembly also includes a bell crank that is pivotally mounted to the housing and operatively engaged with the handle. In addition, the handle assembly includes a release lever that is pivotally mounted to the housing and selectively coupled to the bell crank. The handle assembly also includes a locking lever pivotally mounted to the housing and movable between a lock and an unlock position. Moving the locking lever to the lock position decouples the bell crank from the release lever such that the door latch remains latched upon movement of the handle into either of the first or second actuating positions. Moving the locking lever to the unlock position couples the bell crank to the release lever such that the door latch releases upon movement of the handle into either of the first or the second actuating positions.

BRIEF DESCRIPTION OF THE DRAWINGS

Advantages of the invention will be readily appreciated as the same becomes better understood by reference to the following detailed description when considered in connection with the accompanying drawings wherein:

FIG. 2 is a side view of the handle assembly including a housing and a handle pivotally secured thereto;

FIG. 3 is a top view of the handle assembly;

DETAILED DESCRIPTION OF THE PREFERRED EMBODIMENT

Figure 1:
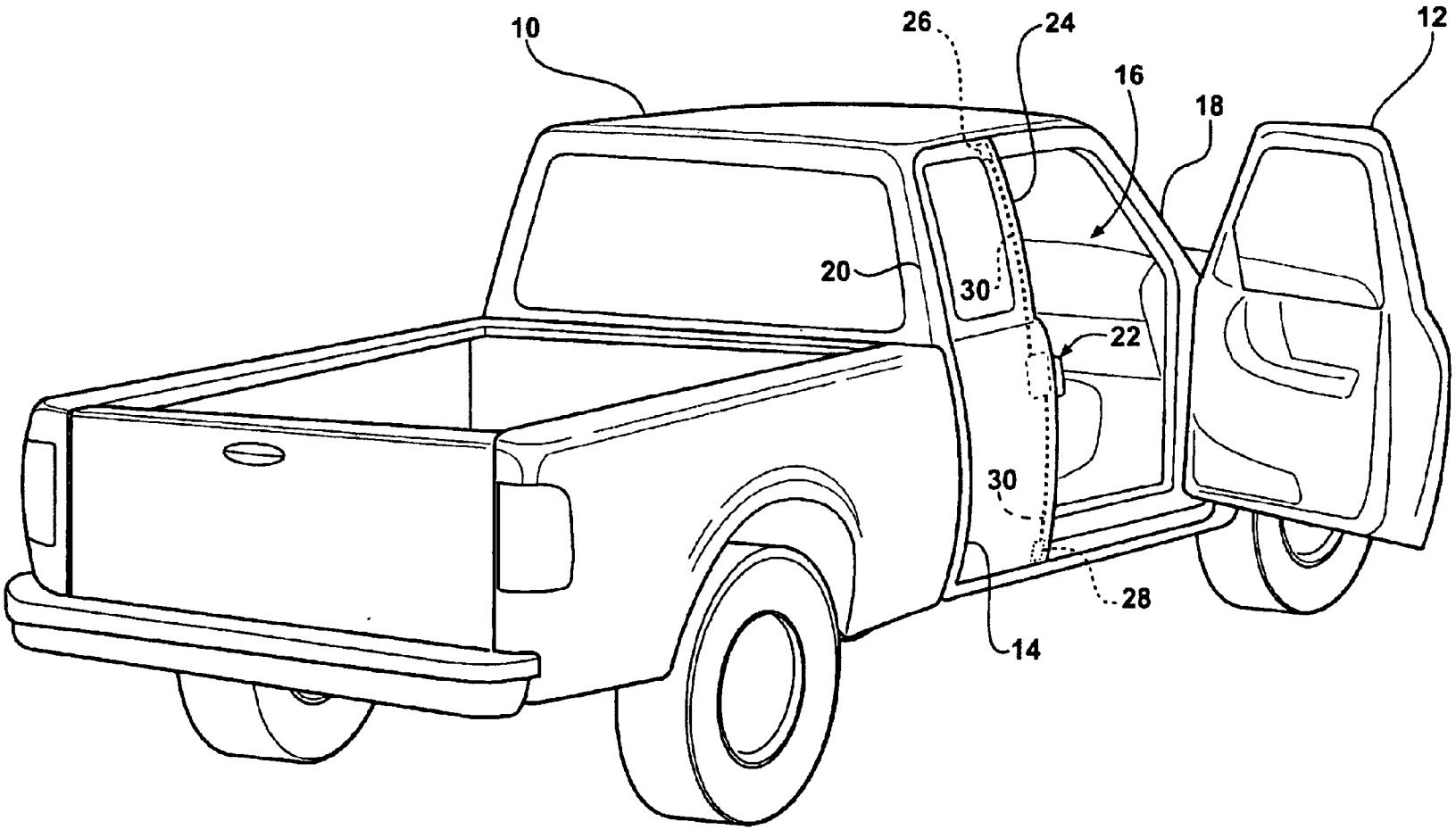
FIG. 1 is a rear perspective view of a motor vehicle including a handle assembly according to the invention secured to a rear door.

Referring to FIG. 1, a motor vehicle 10 includes two primary doors 12 (one shown) and a rear or third door 14 directly rearward thereto for providing access to a passenger compartment 16. In the embodiment shown, the motor vehicle 10 is a pick-up truck. The front door 12 is mounted along an A-pillar 18 and the rear door 14 is mounted along a C-pillar 20, thereby obviating the need for a B-pillar between the A-pillar 18 and the C-pillar 20. The front 12 and rear 14 doors open in opposite directions to allow individuals to comfortably enter and exit a rear portion of the passenger compartment 16. In addition, easy loading and unloading of items into and out of the rear portion of the passenger compartment 16 is provided when the front 12 and rear 14 doors are open.

A handle assembly, generally indicated at 22, is fixedly secured to the rear door 14 and is disposed adjacent a forward vertical edge 24 thereof. The handle assembly 22 is operatively connected to upper 26 and lower 28 door latches by links 30. Upon actuation of the handle assembly 22 when the front door 12 is open, the upper 26 and lower 28 door latches are unlatched to open the rear door 14.

Referring to FIGS. 2 and 3, the handle assembly 22 includes a housing 32 having an interior surface 34 and an opposing exterior surface 36. The housing 32 defines a well or recessed portion 38 along the interior surface 34 having an open end 40 and a closed end 42. The well 38 includes a plurality of screw apertures 44, 46 to receive screws 48, 50 for attachment with a base plate 52 of the housing 32, which is described in greater detail below.

A pivot bar 54 extends through the well 38 adjacent the closed end 42 thereof. A handle 56 is pivotally mounted to the housing 32 by the pivot bar 54. The handle 56 includes an access opening 58, a raised gripping portion 60, and a complementing finger recess 61.

The well 38 also includes well apertures 62. A pair of arms 66, 68 is mounted along opposite ends of the pivot bar 54 and each of the pair of arms 66, 68 extends through one of the well apertures 62. The pivoting of the handle 56 out of and into its rest position responsively pivots the arms 66, 68. Each of the pair of arms 66, 68 terminates at a distal end 70.

With the front door 12 of the motor vehicle 10 opened, the handle 56 is bidirectionally movable from a rest position, shown in FIG. 3, to first and second actuating positions. In the first actuating position, the handle 56 is pivoted out of the well 38 in the direction of arrow A. Such pivotal movement of the handle 56 will typically occur when an individual pulls the handle 56 from inside the motor vehicle 10.

When moving the handle 56 to the second actuating position, the handle 56 is pivoted into the well 38 in the direction of arrow B. Such pivotal movement of the handle 56 will typically occur when an individual pulls the handle 56 from outside the motor vehicle 16. Such bi-directional movement of the handle 56, combined with the placement of the handle assembly 22 at the forward vertical edge 24 of the rear door 14, allows the same handle 56 to be used by operators that may be located either inside or outside the motor vehicle 10.

The base plate 52 of the housing 32 is fixedly secured to the rear door 14 and includes an inboard surface 72, shown in FIGS. 2 and 3. The housing 32 abuts the inboard surface 72 of the base plate 52 such that when the handle assembly 22 is mounted to the rear door 14, the interior surface 34 of the housing 32 faces the inside of the passenger compartment 16.

Figure 4:
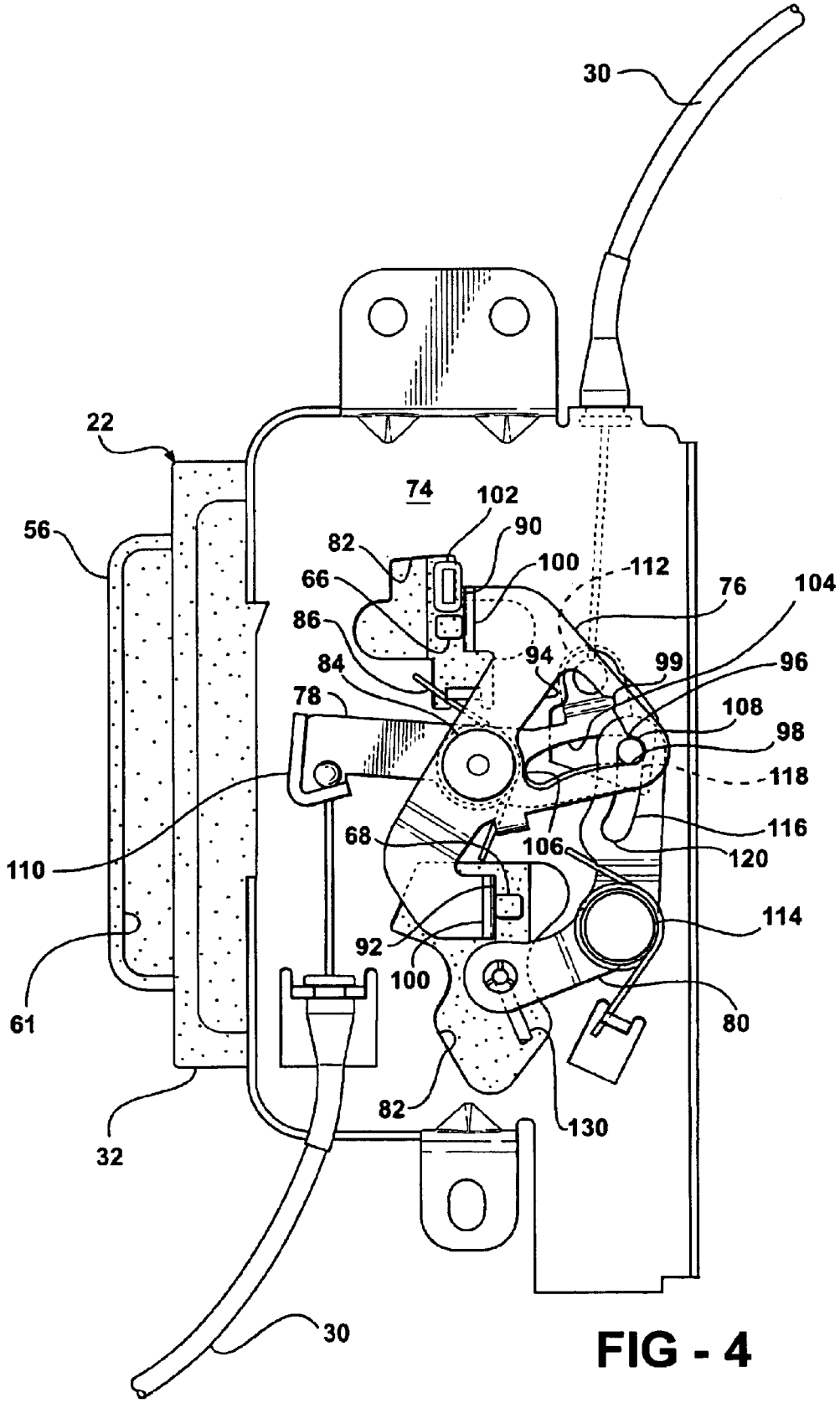
FIG. 4 is a side view taken along lines 4—4 of FIG. 3 with the handle in a rest position.
Figure 5:
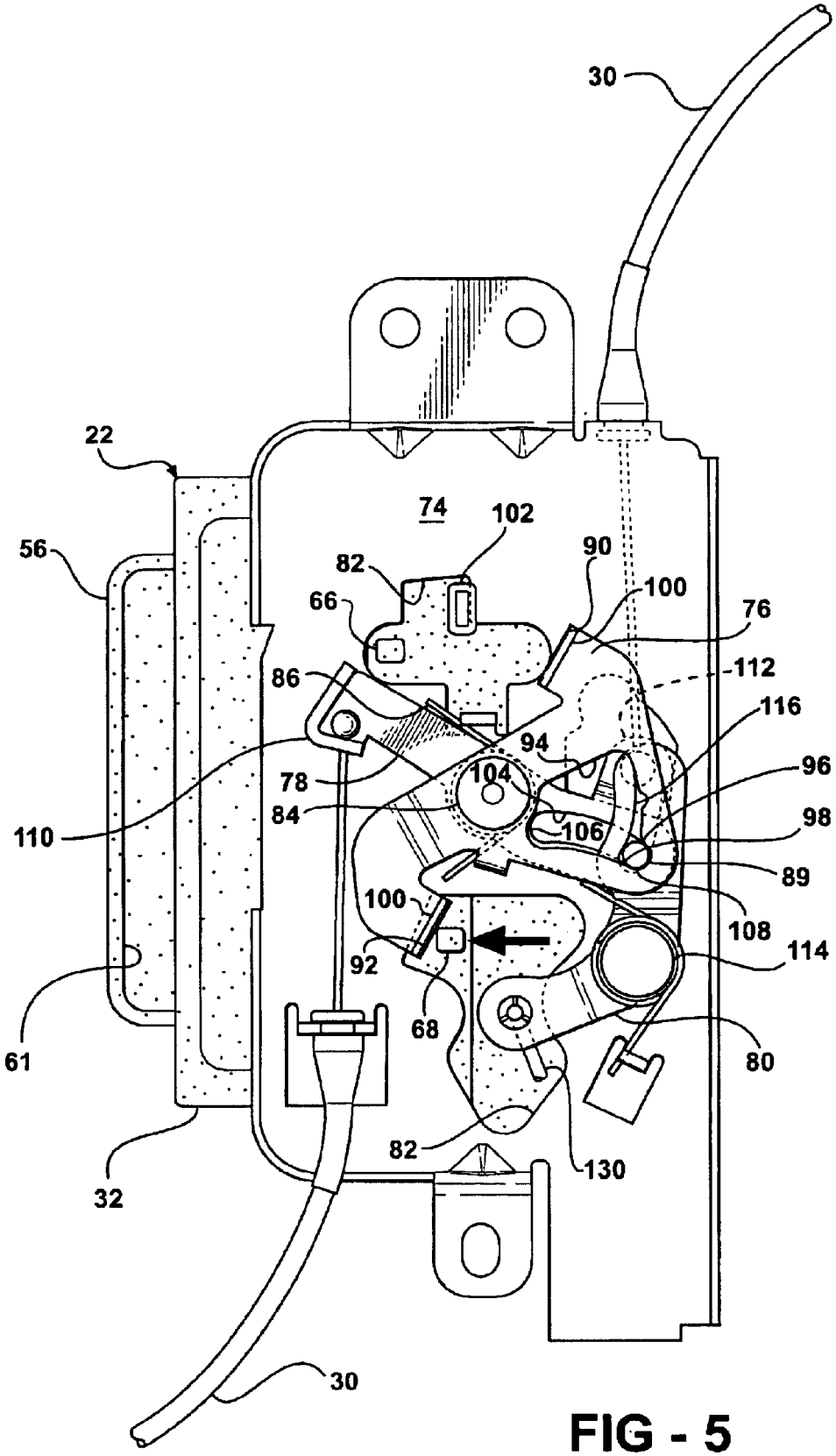
FIG. 5 is a side view taken along lines 4—4 of FIG. 3 with the handle in a first actuating position.
Figure 6:
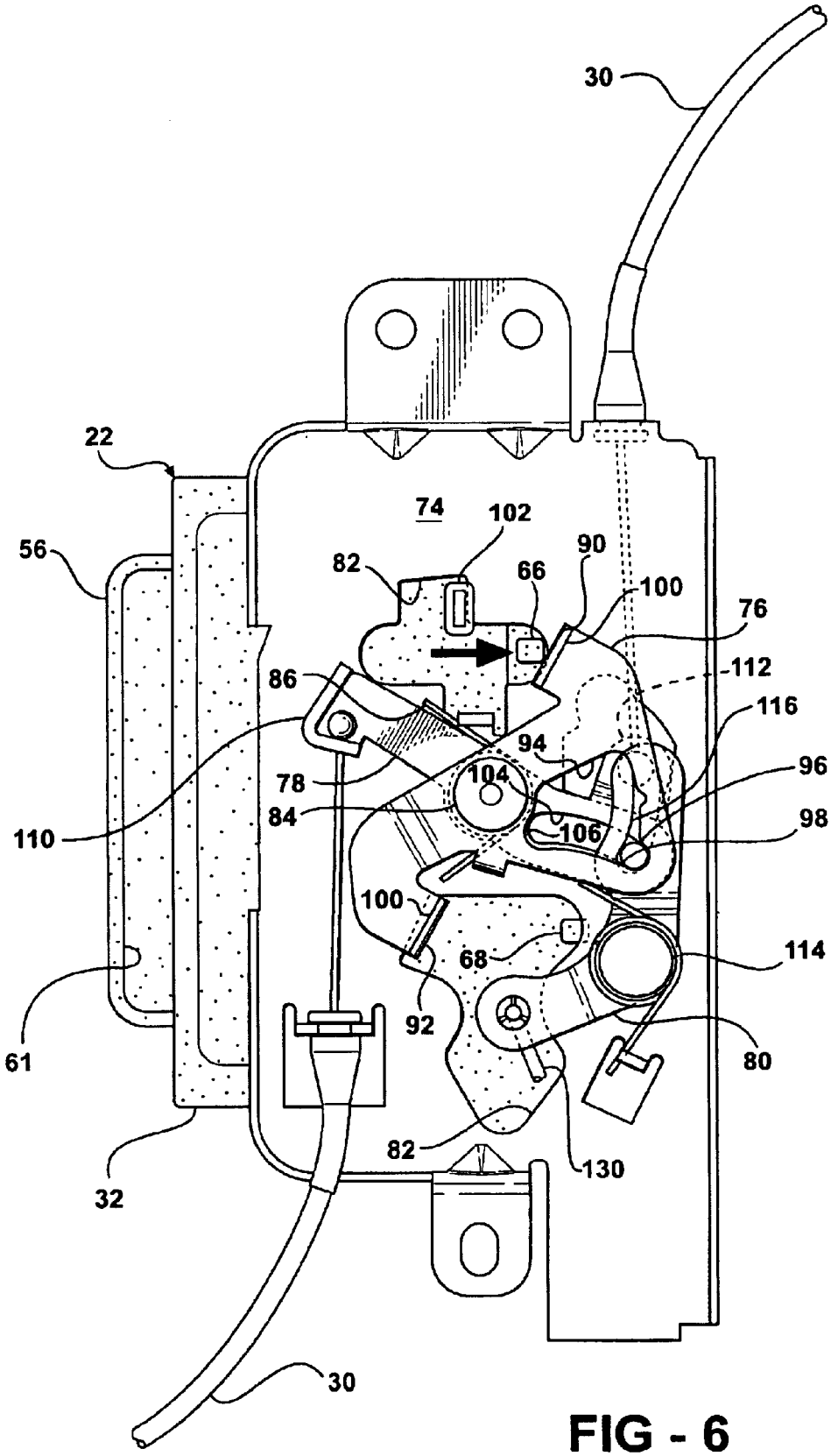
FIG. 6 is a side view taken along lines 4—4 of FIG. 3 with the handle in a second actuating position.

Referring to FIG. 4, the base plate 52 also includes an outboard surface 74 opposite the inboard surface 72. A bell crank 76, release lever 78, and locking lever 80 are each pivotally mounted to the housing 32 along the outboard surface 74 of the base plate 52, as shown in FIGS. 4 through 6. Thus, when the handle assembly 22 is mounted to the rear door 14, the outboard surface 74 of the base plate 52 abuts the rear door 14.

The base plate 52 includes a plurality of access apertures 82. The plurality of access apertures 82 provide access for the pair of arms 66, 68 to engage the bell crank 76 mounted along the outboard surface 74 of the base plate 52.

The bell crank 76 is pivotally mounted about a first pivot pin 84. A spring 86 extends around the first pivot pin 84 to bias the bell crank 76 into a neutral position, as shown in FIG. 4. The bell crank 76 includes a pair of oppositely facing tabs 90, 92. Upon pivoting of the handle 56 out of the rest position in either direction, one of the pair of arms 66, 68 engages one of the oppositely facing tabs 90, 92 to pivot the bell crank 76 out of the neutral position, as shown in FIGS. 5 and 6.

The bell crank 76 also includes a bell crank aperture 94 having a detent 96 defining a nesting portion 89. The detent 96 selectively retains a guide pin 98 in a nesting position to couple the bell crank 76 to the release lever 78 when the bell crank 76 is pivoted by the pair of arms 66, 68, as shown in FIGS. 5 and 6.

The bell crank aperture 94 also includes an upper recess 99. The guide pin 98 is positioned within the upper recess 99 before the handle 56 is assembled with the base plate 52, i.e., during shipping of the parts, to ensure that the pair of oppositely facing tabs 90, 92 is properly engaged with the pair of arms 66, 68 upon assembly.

A bumper 100 is fixedly secured over each of the oppositely facing tabs 90, 92 of the bell crank 76. The bumper 100 absorbs noise vibrations generated by the engagement of the pair of arms 66, 68 with the pair of oppositely facing tabs 90, 92. A stop 102 is fixedly mounted to the base plate 52 along the outboard surface 74 thereof to prevent overtravel of the bell crank 76 after the spring 86 biases the bell crank 76 back to its neutral position, as shown in FIG. 4.

The release lever 78 is also pivotally mounted about the first pivot pin 84. The release lever 78 includes an elongated slot 104 extending between a proximate end 106 and a distal end 108 for receiving the guide pin 98.

The release lever 78 extends between opposing release ends 110, 112. Each of the release ends 110, 112 is attached to one of the links 30. Thus, the pivoting of the release lever 78 pulls each of the links 30 to unlatch the upper 26 and lower 28 door latches.

Figure 8:
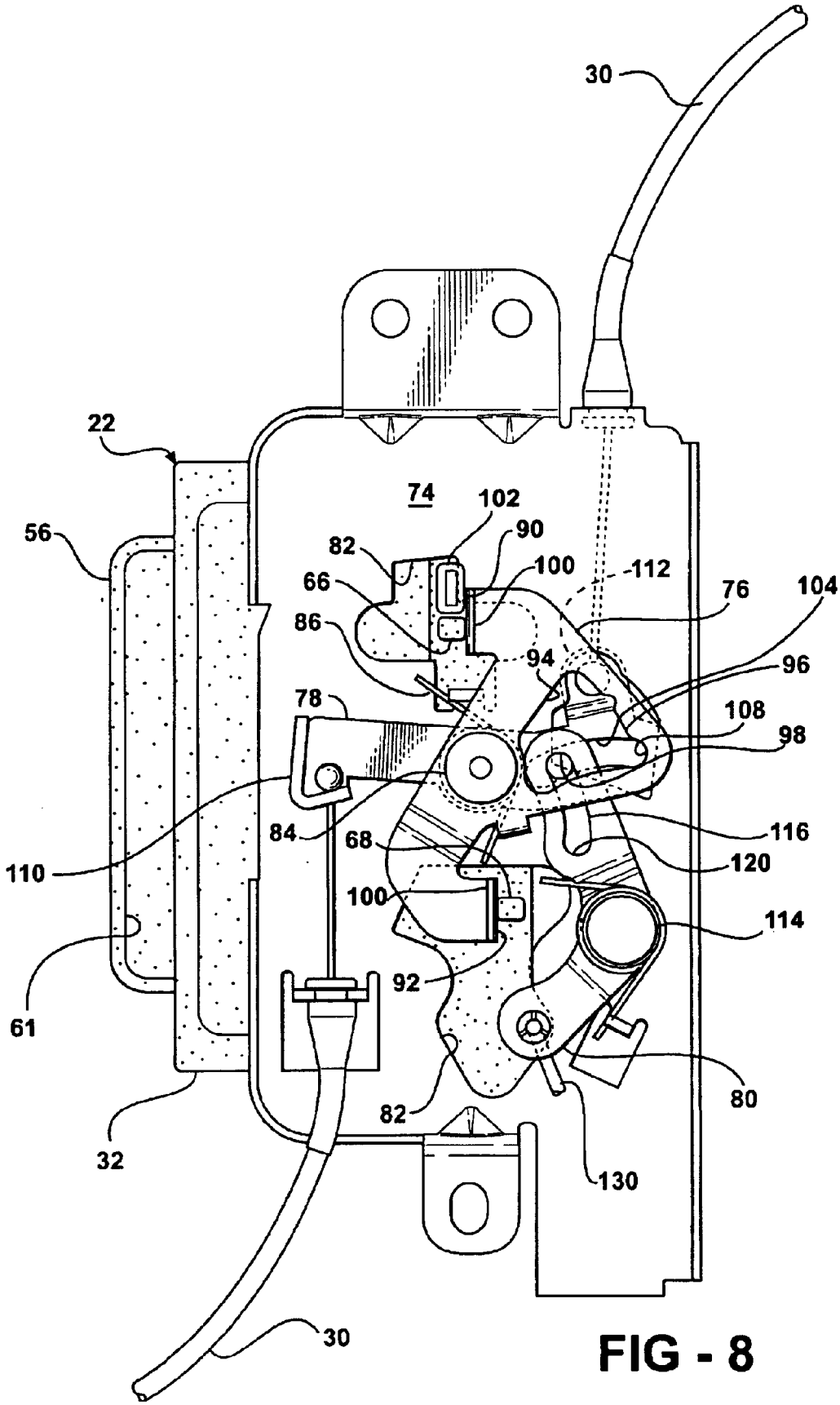
FIG. 8 is a side view taken along lines 4—4 of FIG. 3 with a locking lever in a lock position.
Figure 9:
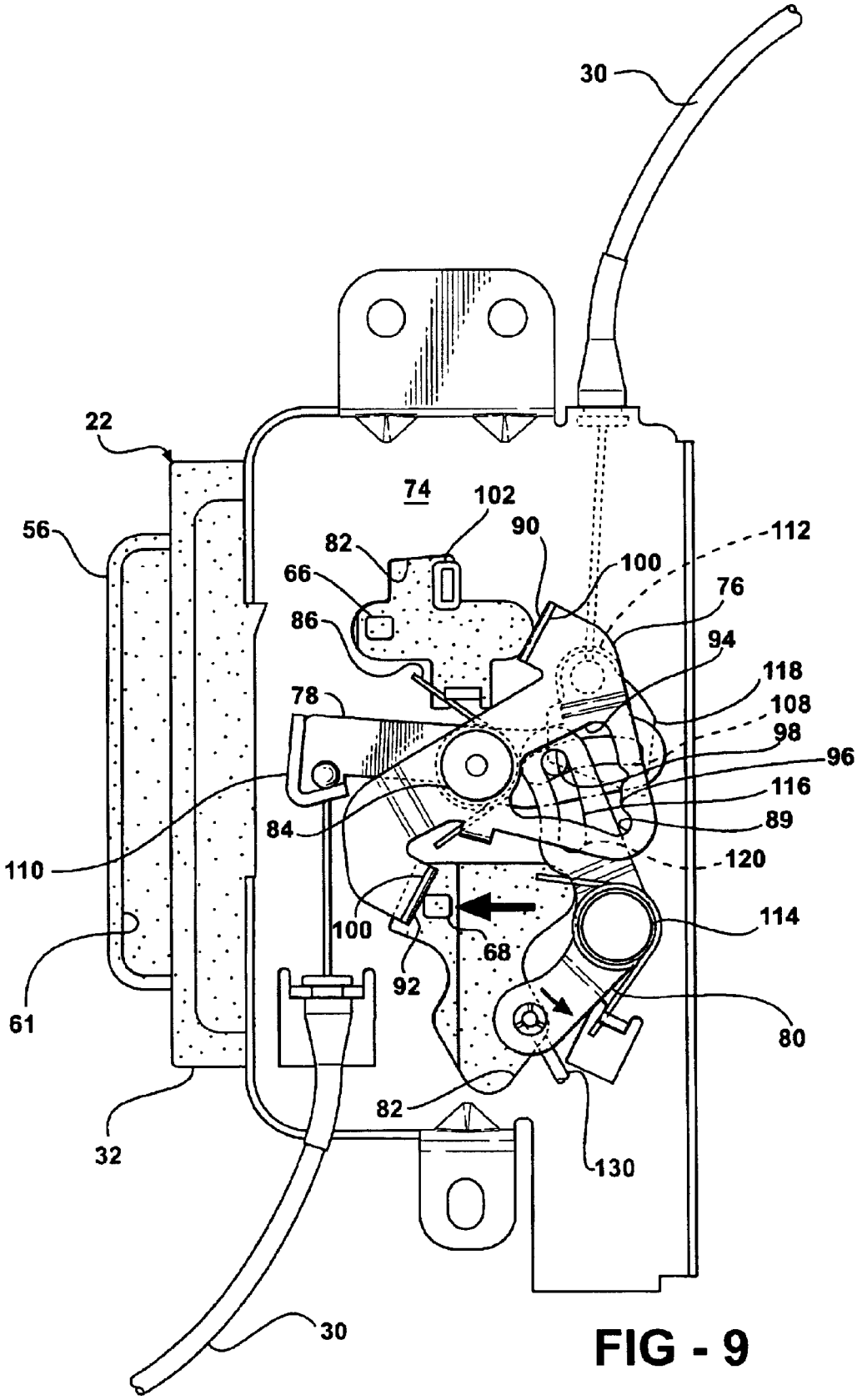
FIG. 9 is a side view taken along lines 4—4 of FIG. 3 with the handle in the first actuating position while the locking lever is in the lock position.
Figure 10:
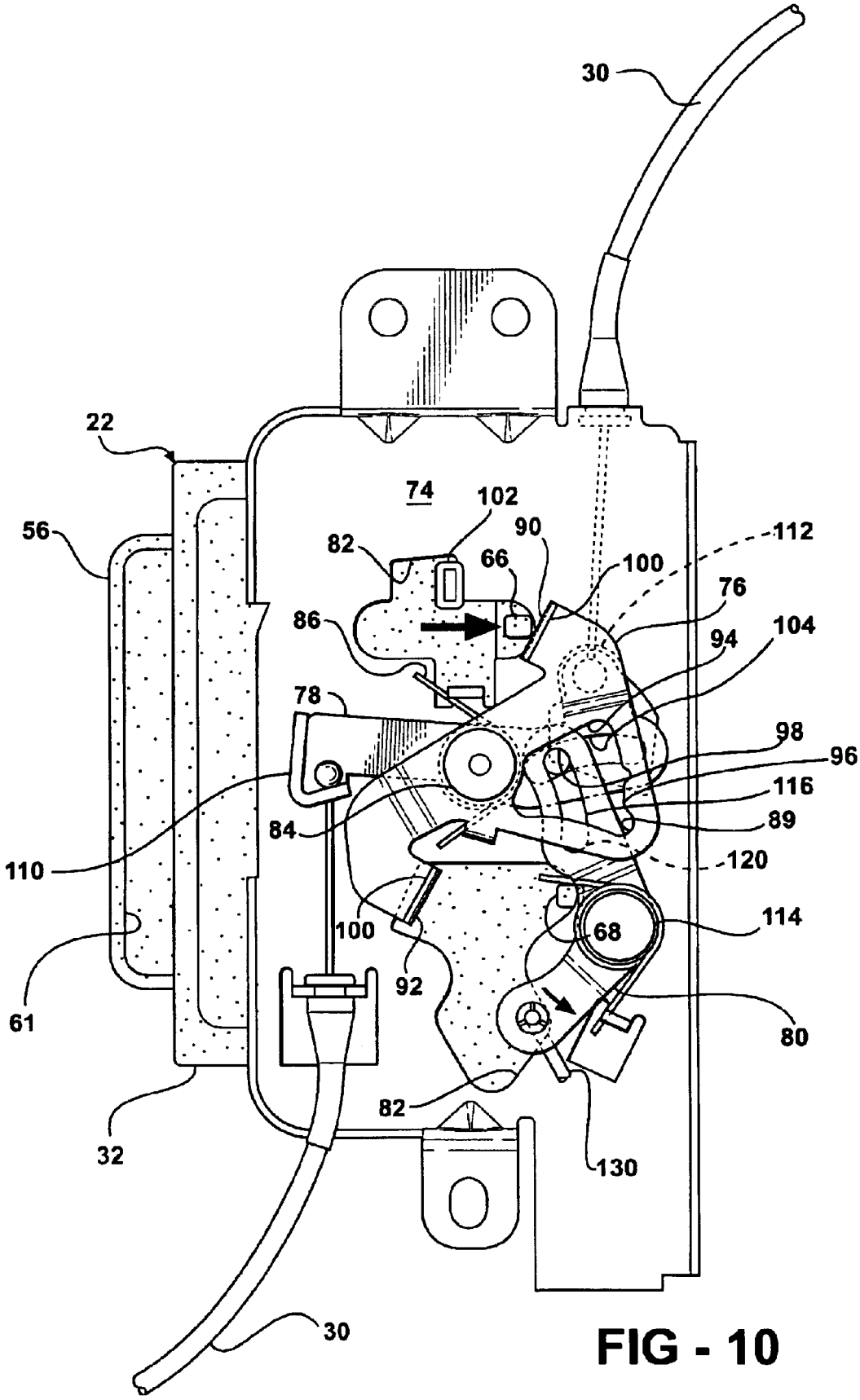
FIG. 10 is a side view taken along lines 4—4 of FIG. 3 of the handle assembly with the handle in the second actuating position while the locking lever is in the lock position.

The locking lever 80 is pivotally mounted about a second pivot pin 114 for movement between an unlock position, as shown in FIGS. 4 through 6, and a lock position, as shown in FIGS. 8 through 10. The locking lever 80 includes a guide slot 116 extending between upper 118 and lower 120 ends. The guide pin 98 is received within the guide slot 116 and moves between the upper 118 and lower 120 ends when the guide pin 98 retained by the detent 96 and the bell crank 76 is pivoted by movement of the handle 56 out of its rest position.

Referring to FIG. 4, when the handle 56 is in the rest position and the locking lever 80 is in the unlock position, the guide pin 98 is retained by the detent 96 of the bell crank aperture 94 in the nesting position. At the same time, the guide pin 98 is located adjacent the distal end 108 of the release lever 78 and at the upper end 118 of the guide slot 116 of the locking lever 80.

Referring to FIG. 5, when an individual actuates the handle 56 to the first actuating position from inside the motor vehicle 10, the handle 56 is pivoted away from the well 38. With the locking lever 80 in the unlock position, this pivoting of the handle 56 causes one 68 of the pair of arms 66, 68 to engage one 92 of the pair of oppositely facing tabs 90, 92 to pivot the bell crank 76. Since the guide pin 98 is in the nesting position, the release lever 78 pivots with the bell crank 76. The pivoting of the release lever 78 pulls the links 30 to unlatch the upper 26 and lower 28 door latches.

Referring to FIG. 6, when an individual actuates the handle 56 to the second actuating position from outside the motor vehicle 10, the handle 56 is pivoted into the well 38. With the locking lever 80 in the lock position, this pivoting of the handle 56 causes the other one 66 of the pair of arms 66, 68 to engage the other one 90 of the pair of oppositely facing tabs 90, 92 to pivot the bell crank 76. Since the guide pin 98 is in the nesting position, the release lever 78 pivots with the bell crank 76. The pivoting of the release lever 78 pulls the links 30 to unlatch the upper 26 and lower 28 door latches.

Figure 7:
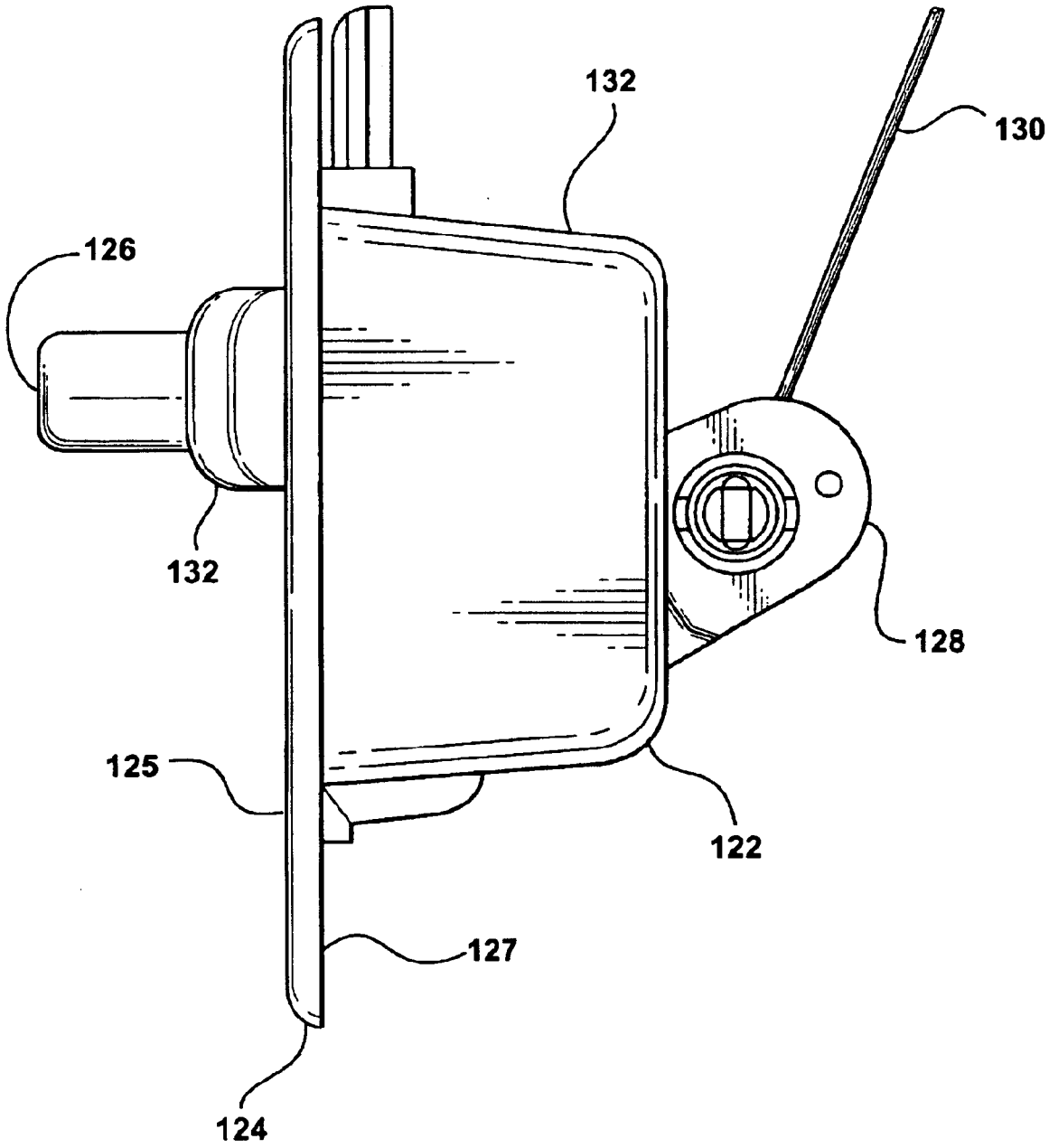
FIG. 7 is a side view of an interlock mechanism.

Referring to FIG. 7, an interlock mechanism 122 is provided for selectively pivoting the locking lever 80 into its lock position, in which the guide pin 98 is moved over the detent 96 and out of the nesting position. When the locking lever 80 is in its lock position, movement of the handle 56 in either direction from its rest position will prevent unlatching of the upper 26 and lower 28 door latches.

The interlock mechanism 122 is mounted to a shut face (not shown) of the rear door 14 and includes a bezel 124. A lockout lever 126 is pivotally mounted along an outer surface 125 of the bezel 124 while an interlock bell crank 128 is pivotally mounted along an opposing inner surface 127 of the bezel 124. A shield 132 is secured to the bezel 124 to prevent moisture from interfering with the lockout lever 126 and the interlock bell crank 128.

When the front door 12 is closed against the rear door 14, the front door 12 engages the lockout lever 126. In response, the lockout lever 126 engages the interlock bell crank 128 to pivot the interlock bell crank 128. A rod 130 extends between the interlock bell crank 128 and the locking lever 80. The pivoting of the interlock bell crank 128 pulls the rod 130 to move the locking lever 80 from its unlock position to its lock position.

Referring to FIG. 8, the locking lever 80 is shown in the lock position with the handle 56 in the rest position. In the lock position, the locking lever 80 urges the guide pin 98 over the detent 96 and out of the nesting position. The movement of the guide pin 98 out of the nesting portion decouples the bell crank 76 from the release lever 78.

Thus, with the front door 12 closed and the locking lever 80 in the lock position, when the handle 56 is pivoted into its first and second actuating positions, as shown in FIGS. 9 and 10 respectively, the bell crank 76 pivots relative to the release lever 78. The release lever 78 remains stationery and, as a result, the links 30 connected thereto are not pulled and the rear door 14 remains latched.

The invention has been described in an illustrative manner. It is to be understood that the terminology, which has been used, is intended to be in the nature of words of description rather than of limitation. Many modifications and variations of the invention are possible in light of the above teachings and thus the invention may be practiced other than as specifically described.

What is claimed is:

1. A handle assembly for unlatching a door latch to open a door of a motor vehicle, said handle assembly comprising:

a housing secured to the door and defining a well;

a handle pivotally secured to said housing, said handle bidirectionally movable from a rest position into and out of said well;

a bell crank pivotally mounted to said housing and operatively engaged with said handle; and a release lever pivotally mounted to said housing and selectively coupled to said bell crank, said release lever operatively connected to the door latch such that movement of said handle in either direction from its rest position pivots said bell crank and said release lever together relative to said housing to open the door.

2. A handle assembly as set forth in claim 1 wherein said handle includes at least one arm for engaging said bell crank to pivot said bell crank upon movement of said handle in either direction from its rest position.

3. A handle assembly as set forth in claim 2 including a guide pin interconnecting said bell crank and said release lever to pivot said release lever as said bell crank is pivoted by said handle.

4. A handle assembly as set forth in claim 3 wherein said bell crank includes a bell crank aperture having a detent for retaining said guide pin in a nesting position coupling said bell crank to said release lever.

5. A handle assembly as set forth in claim 4 including a link extending between said release lever and the door latch wherein pivoting of said release lever pulls said link to unlatch the door latch.

6. A handle assembly as set forth in claim 5 wherein said housing includes a base plate fixedly secured to the door, said bell crank and said release lever pivotally mounted to said base plate along an outboard surface thereof.

7. A handle assembly as set forth in claim 6 wherein said base plate includes access apertures providing access for said arm to engage said bell crank.

8. A handle assembly as set forth in claim 7 wherein said bell crank includes a pair of oppositely facing tabs, one of said oppositely facing tabs engaging said arm.

9. A handle assembly as set forth in claim 8 wherein each of said pair of oppositely facing tabs includes a bumper secured thereto.

10. A handle assembly as set forth in claim 9 including a locking lever pivotally mounted to said base plate for moving said guide pin over said detent allowing said bell crank to move relative to said release lever such that the door latch remains latched upon movement of said handle in either direction from its rest position.

11. A handle assembly as set forth in claim 10 wherein said locking lever includes a guide slot extending between upper and lower ends for receiving said guide pin and allowing said guide pin to move therebetween when said guide pin retained by said detent and said bell crank is pivoted by movement of said handle out of its rest position.

12. A handle assembly for unlatching a door latch to open a door of a motor vehicle, said handle assembly comprising:

a housing secured to the door and defining a well;

a handle pivotally secured to said housing, said handle movable in a first direction from a rest position to a first actuating position located in said well, and movable in a second direction from said rest position to a second actuating position located out of said well;

a bell crank pivotally mounted to said housing and operatively engaged with said handle;

a release lever pivotally mounted to said housing and operatively connected between said bell crank and the door latch;

a locking lever pivotally mounted to said housing and movable between a lock and an unlock position; and wherein moving said locking lever to said lock position decouples said bell crank from said release lever such that the door latch remains latched upon movement of said handle into one of said first and second actuating positions, and moving said locking lever to said unlock position couples said bell crank to said release lever such that the door latch releases upon movement of said handle into one of said first and second actuating positions.

13. A handle assembly as set forth in claim 12 including an interlock mechanism fixedly secured to the door for selectively moving said locking lever to move said guide pin over said detent to prevent movement of said handle to unlatch the door.

14. A handle assembly as set forth in claim 13 including an interlock mechanism having a bezel fixedly secured to the door and operable to move said locking lever between said lock position and said unlock position.

15. A handle assembly as set forth in claim 14 wherein said interlock mechanism includes an interlock bell crank pivotally secured to said bezel and operatively connected to said locking lever for pivoting said locking lever between said lock and unlock positions.

16. A handle assembly as set forth in claim 15 wherein said interlock mechanism includes a rod extending between said interlock bell crank and said locking lever wherein pivoting of said interlock bell crank pulls said rod to pivot said locking lever.

17. A handle assembly as set forth in claim 16 including a guide pin interconnecting said bell crank and said release lever to pivot said release lever as said bell crank is pivoted by said handle.

18. A handle assembly as set forth in claim 17 wherein said bell crank includes a bell crank aperture defining a detent for retaining said guide pin in a nesting position coupling said bell crank to said release lever.

19. A handle assembly as set forth in claim 18 including a link extending between said release lever and the door latch wherein pivoting of said release lever pulls said link to open the door.

20. A handle assembly as set forth in claim 19 wherein said housing includes a base plate fixedly secured to the door and said housing.

21. A handle assembly as set forth in claim 20 wherein said handle includes at least one arm for engaging said bell crank to pivot said bell crank upon movement of said handle in either direction.

22. A handle assembly as set forth in claim 21 wherein said base plate includes access apertures providing access for said arm to engage said bell crank.

23. A handle assembly as set forth in claim 22 wherein said bell crank includes a pair of oppositely facing tabs, one of said oppositely facing tabs engaging said arm.

24. A handle assembly for unlatching a door latch to open a door of a motor vehicle, said handle assembly comprising:

a housing including a base plate fixedly secured to the door and defining a well, said base plate having an outboard surface abutting the door;

a handle pivotally secured to said housing, said handle movable in a first direction from a rest position to a first actuating position located in said well, and movable in a second direction from said rest position to a second actuating position located out of said well;

a bell crank pivotally mounted to said base plate along said outboard surface thereof and operatively engaged with said handle;

a release lever pivotally mounted to said base plate along said outboard surface thereof and operatively connected to the door latch; and a locking lever pivotally mounted to said housing and movable between a lock and an unlock position; and wherein moving said locking lever to said lock position decouples said bell crank from said release lever such that the door latch remains latched upon movement of said handle into one of said first and second actuating positions, and moving said locking lever to said unlock position couples said bell crank to said release lever such that the door latch releases upon movement of said handle into one of said first and second actuating positions.

25. A handle assembly as set forth in claim 24 wherein said handle includes at least one arm for engaging said bell crank to pivot said bell crank upon movement of said handle in either direction from its rest position.

26. A handle assembly as set forth in claim 25 including a guide pin interconnecting said bell crank and said release lever to pivot said release lever as said bell crank is pivoted by said handle.

27. A handle assembly as set forth in claim 26 wherein said bell crank includes a bell crank aperture defining a detent for retaining said guide pin in a nesting position coupling said bell crank to said release lever.

28. A handle assembly as set forth in claim 27 including a link extending between said release lever and the door latch wherein pivoting of said release lever pulls said link to unlatch the door latch.

29. A handle assembly as set forth in claim 28 wherein said base plate includes access apertures providing access for said arm to engage said bell crank.

30. A handle assembly as set forth in claim 29 wherein said bell crank includes a pair of oppositely facing tabs, one of said oppositely facing tabs engaging said arm.

* * * * *